US006918406B2

(12) United States Patent
Bae et al.

(10) Patent No.: US 6,918,406 B2
(45) Date of Patent: Jul. 19, 2005

(54) CHEMICAL SUPPLY APPARATUS

(75) Inventors: Jeong-yong Bae, Chonan-shi (KR); Doo-keun An, Chonan-shi (KR)

(73) Assignee: DNS Korea Co., Ltd., Nam-Do (KR)

( * ) Notice: Subject to any disclaimer, the term of this patent is extended or adjusted under 35 U.S.C. 154(b) by 275 days.

(21) Appl. No.: 10/412,209

(22) Filed: Apr. 14, 2003

(65) Prior Publication Data

US 2003/0227821 A1 Dec. 11, 2003

(30) Foreign Application Priority Data

May 10, 2002 (KR) ..... 10-2002-0025775

(51) Int. Cl.[7] ..... B67D 5/56; B67D 5/60

(52) U.S. Cl. ..... 137/340; 137/563; 137/571; 137/597

(58) Field of Search ..... 137/340, 597, 137/563, 571

(56) References Cited

U.S. PATENT DOCUMENTS 4,474,476 A * 10/1984 Thomsen ..... 366/152.4
4,483,357 A * 11/1984 Rao et al. ..... 137/3
5,507,310 A * 4/1996 Sordello et al. ..... 137/351
5,531,242 A * 7/1996 Paganessi ..... 137/255
5,800,056 A * 9/1998 Suzuki et al. ..... 137/5

* cited by examiner

*Primary Examiner*—Stephen M. Hepperle
(74) *Attorney, Agent, or Firm*—Harness, Dickey & Pierce, P.L.C.

(57) ABSTRACT

The present invention is directed to a chemical supply apparatus including a first tank in which at least two chemicals supplied from each supply bath are mixed, circulating means for circulating the chemicals in the first tank to uniformly mix the chemicals therein, a second tank for storing the mixed solution provided from the first tank, a distributor for distributing the mixed solution to supply the mixed solution to each processing unit, and a heating unit mounted upon a supply line for supplying the mixed solution to the distributor to heat up the mixed solution.

10 Claims, 4 Drawing Sheets

CHEMICAL SUPPLY APPARATUS

This U.S. nonprovisional patent application claims priority under 35 U.S.C. §119 of Korean Patent Application 2002-0025775 filed on May 10, 2002, the entire contents of which is hereby incorporated by reference.

FIELD OF THE INVENTION

The present invention generally relates to a semiconductor manufacturing apparatus and, more particularly, to a chemical supply apparatus for continuously supplying a diluted and mixed chemical to a chemical processing unit.

BACKGROUND OF THE INVENTION

In recent years, various types of chemical supply apparatuses have been employed in the production of semiconductor devices. The chemical supply apparatuses supply chemicals, prepared by diluting stock solutions with pure water or by mixing a plurality of stock solutions, to processing units which are used to fabricate semiconductor devices.

If a chemical supplied to the processing units is unstable due to changes in its composition, aggregation of finely divided particles contained in the chemicals, etc., the semiconductor devices may be defective. Accordingly, what is required is a chemical supply apparatus for supplying stable chemicals.

A conventional chemical supply apparatus for supplying cleaning solution and etchant, which is applied to a single wafer type cleaning and etching equipment, is now described with reference to FIG. 1.

Referring to FIG. 1, chemicals are fed to a mixing tank 14 through a flowmeter 12 according to a measured rate. A heater 16 heats up the chemicals fed to the mixing tank 14. A circulating pump 18 circulates the chemicals in the mixing tank 14 so as to mix the chemicals and achieve a uniform temperature distribution. If the temperature and concentration of the chemicals are within a set value, the chemicals are provided to a nozzle (or processing bath). For example, in case of 300 mm wafer, the amount of a chemical used in each chamber is 0.5 l~1 l/min. Therefore, a chemical tank having a capacity of 45 l can treats 40~80 wafers even considering their loss.

If the chemical level of the mixing tank 14 falls below a dangerous level, chemical supply is stopped and the mixing tank 14 is refilled with the chemical. The chemical refilling includes the steps of (1) providing a chemical to the mixing tank 14 and (2) heating and mixing the chemical to achieve chemical temperature and concentration needed for a process. In general, the chemical refilling takes about 30~60 minutes. The conventional chemical supply apparatus 10 cannot provide a chemical to a processing unit during the time required for the chemical refilling (exchanging). Further, only a few nozzles can be provided to one system in the conventional chemical supply apparatus. Thus the conventional chemical supply apparatus needs the same number of supply means as chambers in order to provide nozzles to lots of chambers. In addition, the conventional chemical supply apparatus cannot recycle and reuse a chemical used in the processing unit.

SUMMARY OF THE INVENTION

A feature of the present invention is to provide a chemical supply apparatus for successively supplying a chemical to a processing unit without the refill time of the chemical.

Another feature of the present invention is to provide a chemical supply apparatus for reusing a chemical used in a processing unit.

Still another feature of the present invention is to provide a chemical supply apparatus for quickly and correctly heating up a chemical and easily dropping in the temperature of the heated chemical.

In order to achieve these features, the present invention provides a chemical supply apparatus comprising a first tank in which at least two chemicals supplied from each supply bath are mixed, circulating means for circulating the chemicals in the first tank to uniformly mix the chemicals therein, a second tank for storing the mixed solution provided from the first tank, a distributor for distributing the mixed solution to supply the mixed solution to each processing unit, and a heating unit mounted upon a supply line for supplying the mixed solution to the distributor to heat up the mixed solution.

In this embodiment, the circulating means includes a circulation line and a first pump mounted upon the circulation line.

In this embodiment, the chemical supply apparatus further comprises a concentration meter for measuring a chemical concentration of the first tank in real time.

In this embodiment, the-chemical supply apparatus further comprises a mixer for mixing the chemicals to supply the mixed chemicals to the first tank.

In this embodiment, the mixer includes an exterior tub having at least one chemical inlet and a chemical injection tub installed in the exterior tub to inject a chemical to the center of the exterior such that the injected chemical is mixed with chemicals flowing from the chemical inlet.

In this embodiment, the chemical supply apparatus further comprises a pressure keeping unit installed between the second tank and the distributor to constantly keep a pressure of the mixed solution supplied to the processing unit to the distributor.

In this embodiment, the chemical supply apparatus further comprises a third tank for retrieving and storing chemicals used in the processing unit and a second pump with a second pump for supplying the chemical retrieved from the third tank to the first tank.

In this embodiment, the heating unit includes a zigzag-shaped heat exchange line with an inlet and an outlet which are coupled to the supply line, a heater for heating up the mixed solution flowing along the heat exchange line, and temperature dropping means for dropping in temperature of the overheated mixed solution.

In this embodiment, the temperature dropping means has many branch lines branching from the supply line and selectively supplying unheated mixed solution to each portion of the heat exchange line.

DESCRIPTION OF THE PREFERRED EMBODIMENT

A chemical supply apparatus according to the present invention will now be described more fully with reference to attached drawings.

Figure 1:
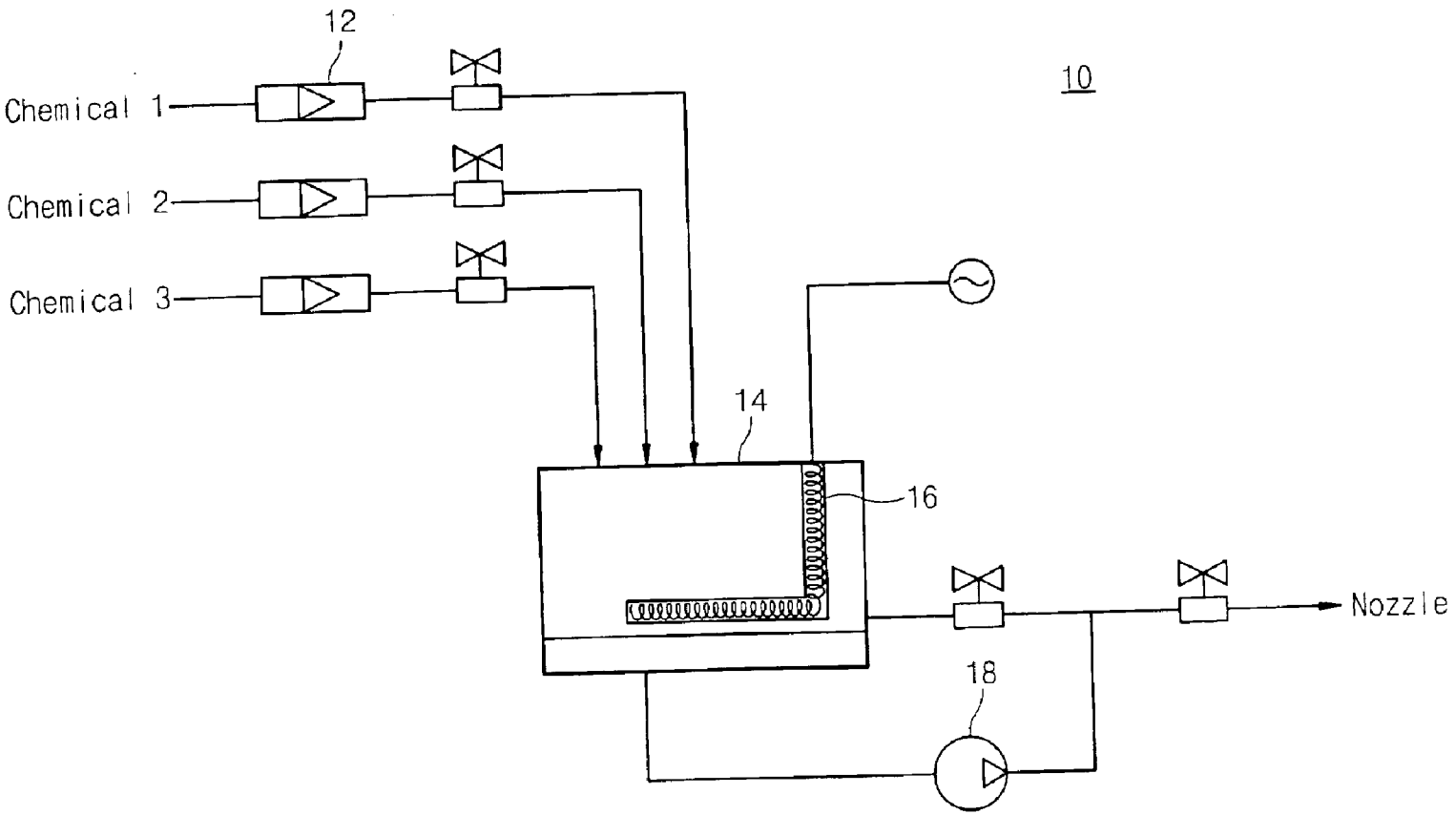
Fig. 1 (Prior Art)
FIG. 1 is a schematic diagram of a conventional chemical supply apparatus.
Figure 2:
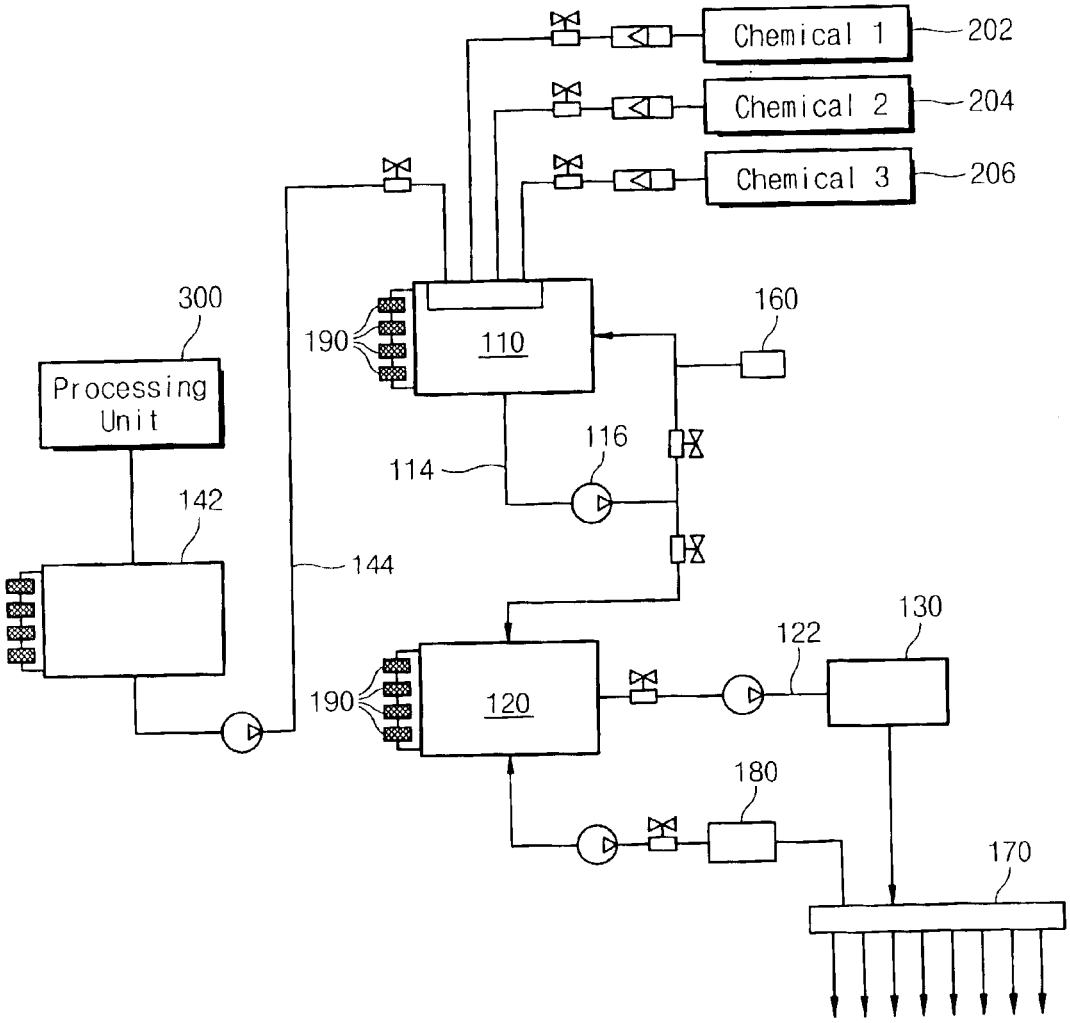
FIG. 2 is a schematic diagram of a chemical supply apparatus according to the present invention.

Referring to FIG. 2, a chemical supply apparatus 100 includes a mixing tank 110, circulating means, a storage tank 120, a heating unit 130, and chemical reusing means 140.

The mixing tank 110 receives chemicals from supply lines 202*a*, 204*a*, and 206*b* which are connected with first, second, and third supply bath 202, 204, and 206 respectively. The chemicals provided to the mixing tank 110 are circulated and mixed through a circulation line 114. Undoubtedly, a circulating pump 116 for forcibly circulating the chemicals is mounted upon the circulation line 114. The mixing tank 110 includes a mixer 150 for efficiently mixing the chemicals, which is now described below with reference to FIG. 3.

Figure 3:
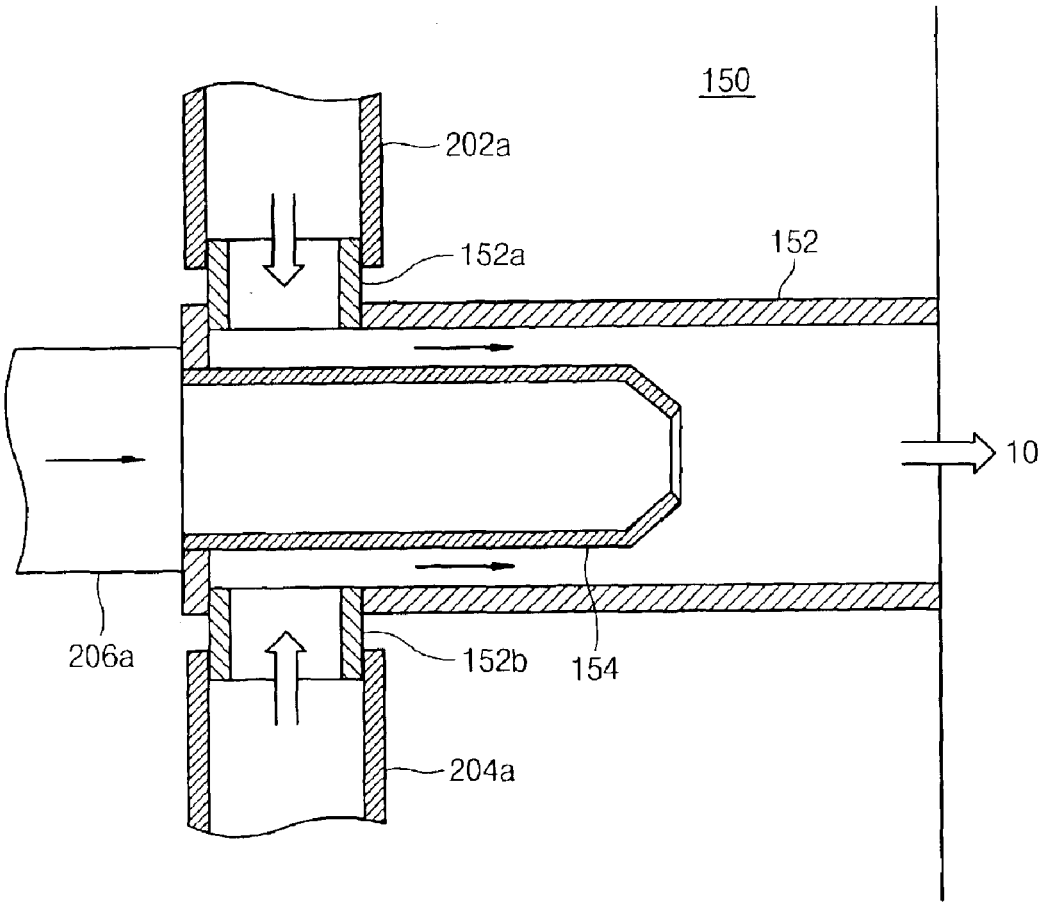
FIG. 3 is a schematic diagram for explaining a mixer shown in FIG. 2.

Referring to FIG. 3, the mixer 150 has an exterior tub 152 with chemical inlets 152*a* and 152*b* and a chemical injection tub 154 constructed in the exterior tub 152. The chemical inlets 152*a* and 152*b* are coupled to supply lines 202*a* and 204*a*, respectively. The first and second chemicals flow through the chemical inlets 152*a* and 152*b*. A supply line 206*a* coupled to the third supply bath 206 is connected with the chemical injection tub 154. The chemical is supplied to the chemical injection tub 514 to mix the first and second chemicals flowing from the chemical inlets 152*a* and 152*b*. That is, the chemicals are supplied to the mixing tank 110 through the mixer 150 to mix the chemicals more quickly.

Returning to FIG. 2, the mixing tank 110 receives not only new chemicals but also a chemical used in the processing unit 300. The chemical used in the processing unit 300 is stored in the recycle tank 142 of the chemical reusing means. The chemical stored in the recycle tank 142 is supplied to the mixing tank 110 through a chemical supply line 144. Since the reused chemical is provided to the mixing tank 110 to be mixed, a concentration meter 160 is installed to measure a concentration in real time.

A mixed solution, which is mixed in the mixing tank 110, is not supplied to the processing unit 300 but is stored in the storage tank 120. The storage tank 120 acts as a buffer space for temporarily storing the mixed solution before supplying the mixed solution to the processing unit 300. The mixed solution stored in the mixing tank 120 is provided to the processing unit 300 through a distributor 170. Thus, the chemical supply apparatus 100 can successively supply chemicals to processing units irrespective of the chemical refill time.

The mixed solution is not supplied to the distributor 170 after being heated up, but is heated by the heating unit 130 while being transported from the storage tank 120 to the distributor 170.

The heating unit 130 is installed on a supply line 122 for connecting the storage tank 120 with the distributor 170, which is now described below with reference to FIG. 4.

Figure 4:
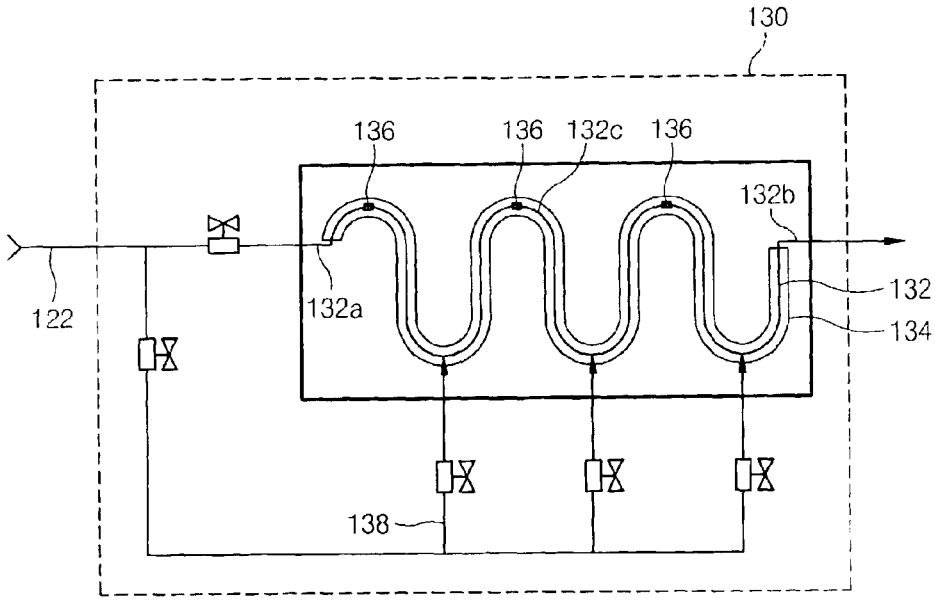
FIG. 4 is a schematic diagram for explaining a heating unit shown in FIG. 2.

Referring to FIG. 4, the heating unit 130 includes a heat exchange line 132, a heater 134, temperature sensors 136, and temperature dropping means. The heat exchange line 132 has an inlet 132*a* connected to the supply line 122 and an outlet 132*b*. The heat exchange line 132 has a zigzag structure in which there are many turning portions 132*c*. The heat exchange line 132 is enclosed in the heater 134. Preferably, the heater 134 has a power of 20–30 kilowatts which is sufficient to temporarily heat up the chemical of 15 l/min. The mixed solution is heated by the heater 134 while passing the heat exchange line 132. In order to check a temperature at each section, the temperature sensors 136 is mounted upon the turning portions 132*c*.

The temperature dropping means is to drop in temperature of the mixed solution which is overheated in the heat exchange line 132. The temperature dropping means includes branch lines 138 each having a valve. The branch lines branch from the supply line 122 in which an unheated mixed solution flows to be connected with the turning portions 132*c* of the heat exchange line 132, respectively. The temperature dropping means supplies the unheated mixed solution to an overheated section through the branch line 138 to drop in temperature of the overheated mixed solution. The mixed solution passing the heating unit 130 is transported and supplied to each processing units and partially returns to the storage tank 120 through the pressure keeping unit 180.

Figure 5:
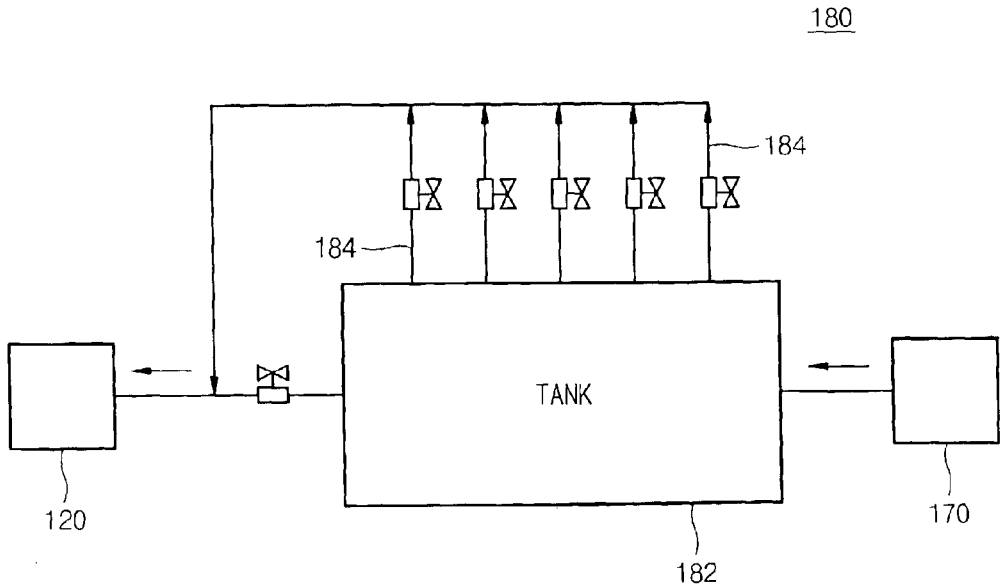
FIG. 5 is a schematic view of a pressure keeping unit.

Returning to FIG. 2, the distributor 170 is constructed to supply a chemical to many processing units (nozzle, bath) and is controlled to keep a pressure applied to the respective processing units within a set value. For this, the pressure keeping unit 180 is installed between the storage tank 120 and the distributor 170. Referring to FIG. 5, the pressure keeping unit 180 has a tank 182 and pressure control lines 184 with many valves or pressure switches. The pressure keeping unit 180 keeps a pressure of the distributor 170 within a set value.

Level sensors 190 for checking water surface levels are installed at the mixing tank, the storage tank, and the recycle tank, respectively. Although not shown in the figures, it will be understood that the valves, the pump, and the heater are connected with a chemical controller to be controlled.

As explained so far, chemicals can be successively supplied to a processing unit irrespective of chemical refill time. Further, chemicals used in the processing unit can be reused. In addition, the chemical can be heated correctly and quickly.

While the present invention has been depicted and described in detail herein, it will be apparent to a person skilled in the art that various modifications, additions, substitutions and the like may be made without departing from the spirit of the invention and these are therefore considered to be within the scope of the invention as defined in the following claims.

What is claimed is:

1. A chemical supply apparatus comprising:

a first tank in which at least two chemicals supplied from at least two supply bath are mixed;

circulating means for circulating the chemicals in the first tank to uniformly mix the chemicals therein;

a second tank for storing the mixed solution provided from the first tank;

a distributor for distributing the mixed solution to supply the mixed solution to each processing unit; and a heating unit mounted upon a supply line for supplying the mixed solution to the distributor to heat up the mixed solution.

2. The chemical supply apparatus of claim 1, wherein the circulating means includes a circulation line and a first pump mounted upon the circulation line.

3. The chemical supply apparatus of claim 1, further comprising a concentration meter for measuring a chemical concentration of the first tank in real time.

4. The chemical supply apparatus of claim 1, further comprising a mixer for mixing the chemicals to supply the mixed chemicals to the first tank.

5. The chemical supply apparatus of claim 4, wherein the mixer includes:

an exterior tub having at least one chemical inlet;

a chemical injection tub installed in the exterior tub to inject a chemical to the center of the exterior such that the injected chemical is mixed with chemicals flowing from the chemical inlet.

6. The chemical supply apparatus of claim 1, further comprising a pressure keeping unit Installed between the second tank and the distributor to constantly keep a pressure of the mixed solution supplied to the processing unit to the distributor.

7. The chemical supply apparatus of claim 1, further comprising:

a third tank for retrieving and storing chemicals used in the processing unit; and a second pump with a second pump for supplying the chemical retrieved from the third tank to the first tank.

8. The chemical supply apparatus of claim 1, wherein the heating unit includes:

a zigzag-shaped heat exchange line with an inlet and an outlet which are coupled to the supply line;

a heater for heating up the mixed solution flowing along the heat exchange line; and temperature dropping means for dropping in temperature of the overheated mixed solution.

9. The chemical supply apparatus of claim 8, wherein the temperature dropping means has many branch lines branching from the supply line and selectively supplying unheated mixed solution to each portion of the heat exchange line.

10. The chemical supply apparatus of claim 1, further comprising a water surface level sensor constructed in the respective first and second tanks.

* * * * *